US007448686B2

(12) United States Patent
Hersh

(10) Patent No.: US 7,448,686 B2
(45) Date of Patent: Nov. 11, 2008

(54) DENTAL CHAIR HEADREST

(75) Inventor: Nelson Mark Hersh, 5221 N. Bay Dr., Orchard Lake, MI (US) 48324

(73) Assignee: Nelson Mark Hersh, Orchard Lake, MI (US)

( * ) Notice: Subject to any disclaimer, the term of this patent is extended or adjusted under 35 U.S.C. 154(b) by 122 days.

(21) Appl. No.: 11/264,809

(22) Filed: Oct. 31, 2005

(65) Prior Publication Data

US 2006/0113830 A1 Jun. 1, 2006

Related U.S. Application Data

(60) Provisional application No. 60/623,244, filed on Nov. 1, 2004.

(51) Int. Cl.
*A47C 7/36* (2006.01)
*A61G 15/00* (2006.01)

(52) U.S. Cl. ..... 297/397; 297/391; 297/398; 297/405; 297/406; 297/408

(58) Field of Classification Search ..... 297/391, 297/397, 398, 405, 406, 408; 5/622, 638
See application file for complete search history.

(56) References Cited

U.S. PATENT DOCUMENTS

| | | | | | |
|---|---|---|---|---|---|
| 619,272 | A | * | 2/1899 | Browne | 297/405 |
| 1,871,221 | A | * | 8/1932 | Miller | 297/283.4 |
| 1,940,361 | A | * | 12/1933 | May | 297/391 |
| 3,936,091 | A | | 2/1976 | Rabinowitz | |
| 4,017,118 | A | | 4/1977 | Cawley | |
| 4,113,309 | A | | 9/1978 | Brockway | |
| RE29,811 | E | | 10/1978 | Norris | |
| 4,335,920 | A | | 6/1982 | Hirth | |
| 4,375,902 | A | | 3/1983 | Tai et al. | |
| 4,415,203 | A | | 11/1983 | Cawley | |
| 4,515,406 | A | | 5/1985 | Fujiyama et al. | |
| 4,647,108 | A | | 3/1987 | Hayashi | |
| 4,998,303 | A | | 3/1991 | Smithers | |
| 5,040,939 | A | | 8/1991 | Booth | |
| 5,214,815 | A | * | 6/1993 | Agbodoe et al. | 5/637 |
| 5,317,771 | A | * | 6/1994 | Cook | 5/637 |
| 5,346,283 | A | | 9/1994 | Steininger et al. | |
| D357,834 | S | | 5/1995 | Nordstrom | |
| 5,586,351 | A | * | 12/1996 | Ive | 5/655 |
| 5,730,497 | A | | 3/1998 | Raymond et al. | |
| D425,341 | S | | 5/2000 | Smith et al. | |
| 6,533,359 | B1 | * | 3/2003 | Holstensson | 297/391 |
| 6,557,195 | B2 | * | 5/2003 | Dinkler | 5/601 |
| 6,626,496 | B2 | | 9/2003 | Beach et al. | |
| 2002/0017812 | A1 | | 2/2002 | Beach et al. | |
| 2003/0178880 | A1 | * | 9/2003 | Hannah | 297/406 |
| 2004/0107502 | A1 | | 6/2004 | Boone | |

* cited by examiner

*Primary Examiner*—Sarah B McPartlin
(74) *Attorney, Agent, or Firm*—Michael A. Glenn; Glenn Patent Group

(57) ABSTRACT

A headrest for a dental chair that provides both the desirable support to a patient's head as well as avoiding damage to hairstyling is disclosed. The invention provides a U-shaped headrest that allows for comfortable resting of a patient's head on the headrest. The U-shape may be subject to a variety of mechanical changes, for example, making an opening bigger or. smaller, or changes in the angle of the headrest itself so that it better fits the counter of a patient's head. Such changes may be made through manual, pneumatic, or electrical control, or combinations thereof.

9 Claims, 5 Drawing Sheets

DENTAL CHAIR HEADREST

CROSS REFERENCE TO RELATED APPLICATIONS

This application takes priority from U.S. provisional patent application Ser. No. 60/623,244, filed on Nov. 1, 2004, and which is incorporated, reference thereto.

BACKGROUND OF THE INVENTION

1. Technical Field

The invention relates to headrests. More particularly, the invention relates to headrests for medical treatment structures, and still more particularly, to headrests for dental chairs.

2. Discussion of the Prior Art

Handling a patient's hair during a medical procedure, such as dental work, is usually not of paramount importance to the healthcare provider. A patient's head is placed on a headrest in a position most convenient to the service provider, for example a dentist, while providing adequate comfort to the patient receiving the treatment.

Generally, headrests are designed to provide support to an average patient's head. Many prior art solutions show how to provide additional types of support to the head itself. For example, in some cases the headrest includes a neck-supporting bulge to avoid neck pain associated with receiving treatment for a prolonged period of time while resting one's head against a relatively flat headrest.

Raymond et. al, U.S. Pat. No. 5,730,497, provides a headrest where the hair of a patient receiving a treatment is supported such that the patient's hair is prevented from hanging down. By securing the hair in position, regardless of the motion of the headrest, that the patient's hair does not move when the headrest does. However, this solution, as with other prior art approaches, is not concerned with the effect of the headrest on the hairstyling of the patient. At best, prior art solutions provide a head support with a recess complementary to the back of an average human head. In some cases, the headrest is further adjustable to fit a plurality of head sizes, or the headrest itself can be replaced with another sized headrest.

Specifically, the design of the headrests is such that, as shown in FIGS. 1A and 1B, support is provided to the patient's head by a headrest 110, and to the patients neck by a neck support 120. However, a patient having a ponytail, a bun, spikes, or any other protruding kind of hairstyle, would easily deform, distort, or otherwise mutilate the hairstyle, or would at least be uncomfortably placed in the headrest.

Therefore, in view of the limitations of prior art solutions it would be advantageous to have a headrest that provides a sufficient support to a patient's head while receiving a treatment, but that avoid damaging or spoiling the hairstyle of the person receiving such treatment.

SUMMARY OF THE INVENTION

During the treatment of teeth by a dentist or dental specialist the patient's head rests on a headrest. The position of the head towards the caretaker, as well as the comfort of the patient, are very important for a successful treatment. Such comfort is often prevented due to hairstyling that is not accommodated by the design of the headrest. The invention provides a U-shaped headrest that allows for comfortable resting of a patient's head on the headrest. The U-shape may be subject to a variety of mechanical changes, for example, making an opening bigger or smaller, or changes in the angle of the headrest itself so that it better fits the counter of a patient's head. Such changes may be made through manual, pneumatic, or electrical control, or combinations thereof.

DETAILED DESCRIPTION OF THE INVENTION

Figure 1A:
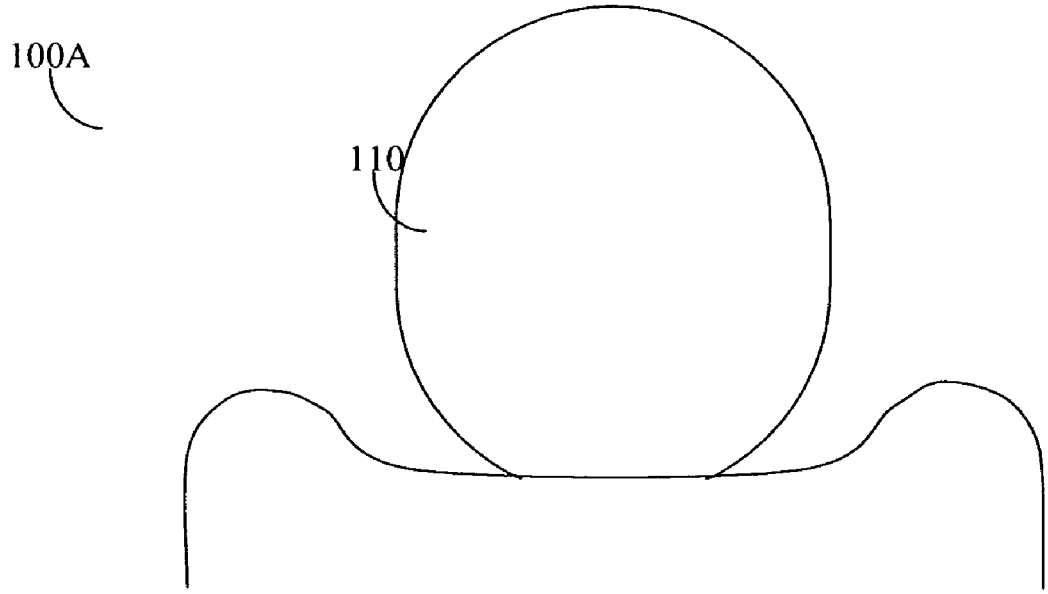
FIGS. 1*a* and 1*b* show an exemplary prior art headrest.
Figure 1B:
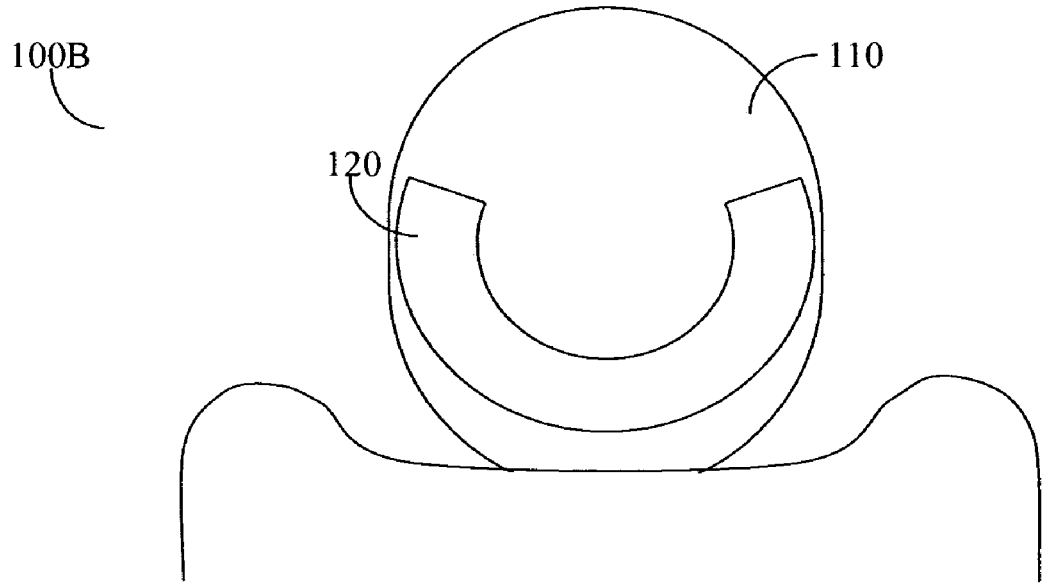
Figure 2:
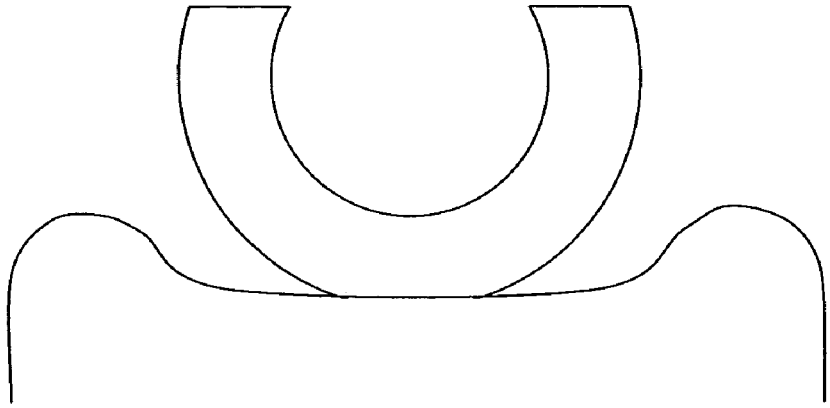
FIG. 2 shows a dental chair equipped with a headrest in accordance with the disclosed invention.
Figure 3:
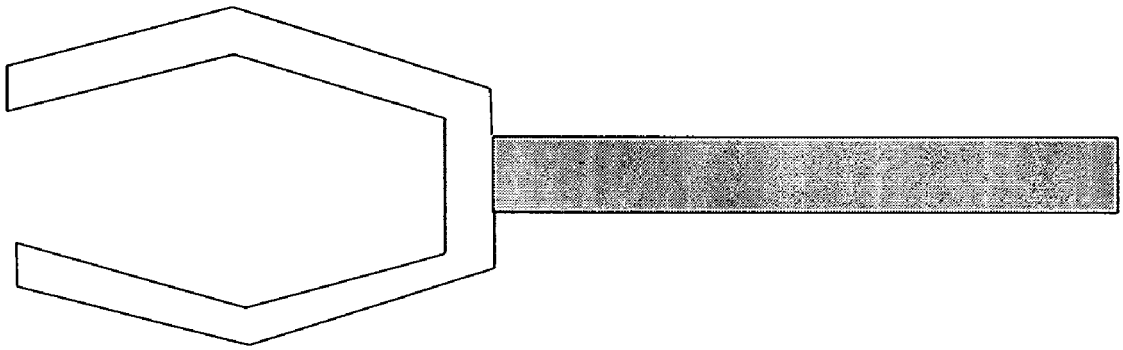
FIG. 3 shows a U-shaped headrest.

The invention takes note of the fact that a person, in particular those who are concerned with their appearance and hairstyle, encounter a problem when using standard headrests, e.g. in medical offices in general and dental offices in particular. Specifically, the design of most headrests is such that a patient having a pony tail, a bun, spikes, or any other protruding kind of hairstyle would easily deform, distort, or otherwise mutilate the hairstyle, or would at least be uncomfortably placed in a prior art type headrest. Therefore, a new headrest is disclosed as shown in FIGS. 2 and 3, that provides a U-shaped design that allows a person's hair to extend through the headrest, that stabilizes the person's head, and that allows for ample support for the person's head, while avoiding the problems associated with the prior art s approaches. Additionally, the inventive design allows for proper disinfection between uses because, as there is no need for an additional pad or accessory pillow, thus a disposable headrest cover can be provided if desired.

Figure 4:
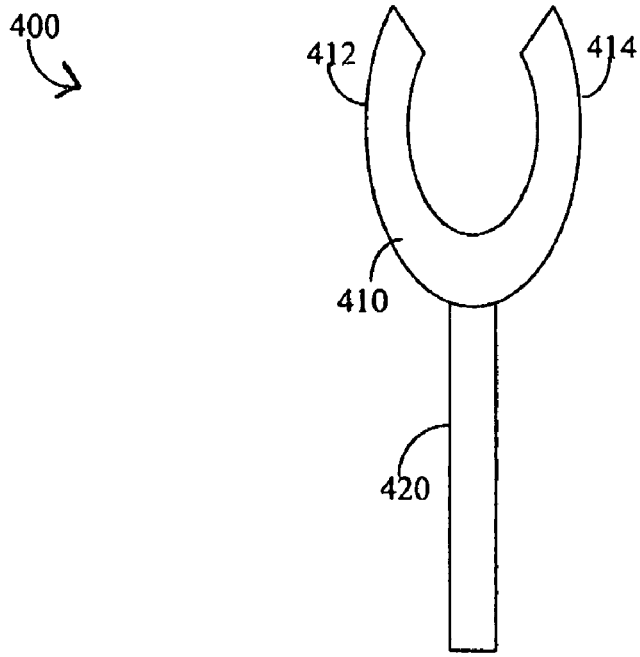
FIG. 4 is a schematic diagram showing a U-Shaped headrest.

FIG. 4 is a schematic diagram showing a headrest 400. A U-shaped headrest 410 is formed of two arms 412 and 414, the arms may be solid or articulated, the latter being adjustable as to the shape of the arms. While a U-shape is shown, other shapes, e. g. V-shaped, oval, or round, may be used. The headrest 410 is connected to a handle 420 that is used for insertion of the headrest 410 into a respective cavity in a medical chair, for example a dental chair. The handle preferably made in a standard dimension, such that the herein disclosed headrest is readily fitted to existing medical chairs. The headrest 410 may tilt up and down in respect of the handle 420, as well as left and right, all for the purpose of allowing a more comfortable position for the patient, as well as for the person providing care to the patient. Such tilting may be performed manually, pneumatically, or electrically using means known to those skilled in the art. The headrest can have dimensions that conform to any standard chair and can be articulating or non-articulating.

When a patient places his head on the headrest, the patient's hair protrudes from the vacancy in the center of the U-shape and, hence, no adverse effects occur to the patient's hairstyling. Moreover, the patient having such a hairstyle is more comfortable when using the headrest 410 because the patient's hair does not drive the patient's head into awkward and uncomfortable positions.

The arms 412 and 414 of headrest 410 are coated with a cushioning material, as is known in art, to enhance the comfort level of the patient. In one embodiment of the invention, the free edges of the arms 412 and 414 are adjusted to bring them closer or farther away from each other. Such adjustment may be done manually, pneumatically, or electrically using means known to those skilled in the art.

Figure 5:
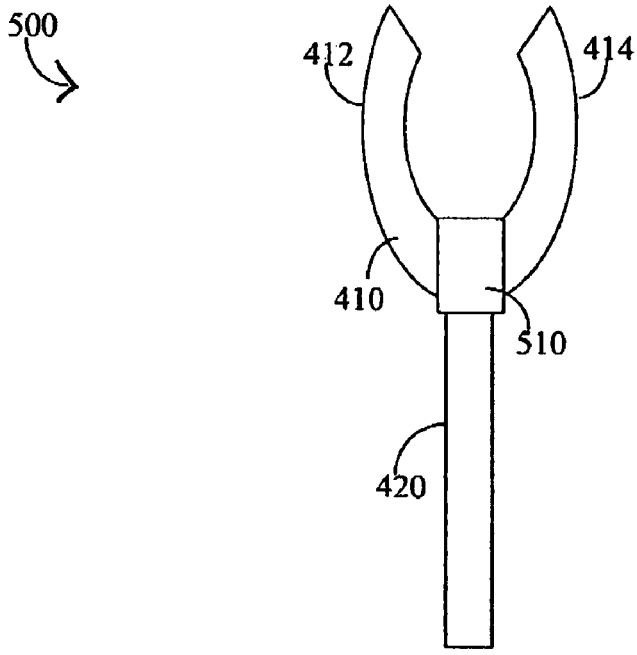
FIG. 5 is a schematic diagram showing a U-shaped headrest with moving arms.

FIG. 5 is a schematic diagram showing a headrest 400. In addition to the capabilities shown in the headrest of FIG. 4, the headrest in FIG. 5 has a holder 510 in which the arms 412 and 414 may move, thus allowing for spacing of the arms of the U-shaped structure 410, while maintaining the general shape of each arm. Such motion of the arms 412 and 414 may be achieved manually, pneumatically, or electrically using means in the holder 510 as are known to those skilled in the art.

Figure 6A:
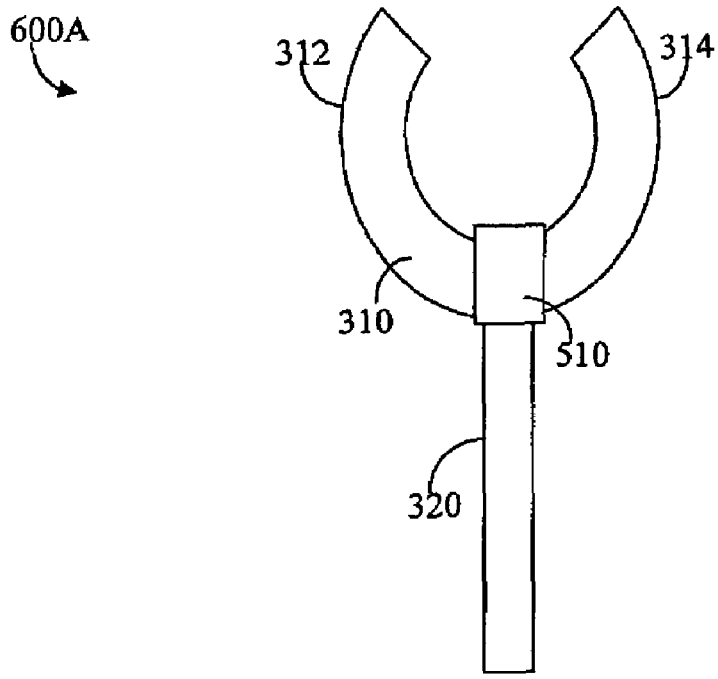
FIGS. 6*a*-6*c* show exemplary adjustment positions of a headrest according to the invention.
Figure 6B:
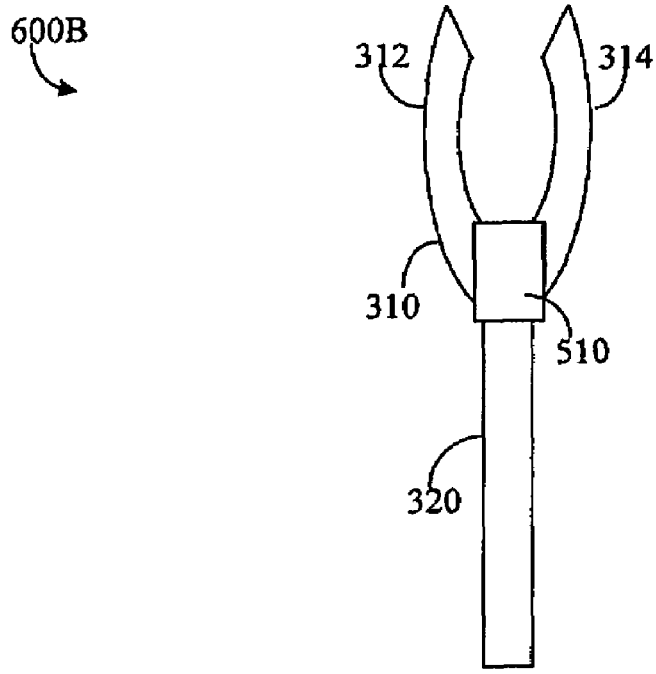
Figure 6C:
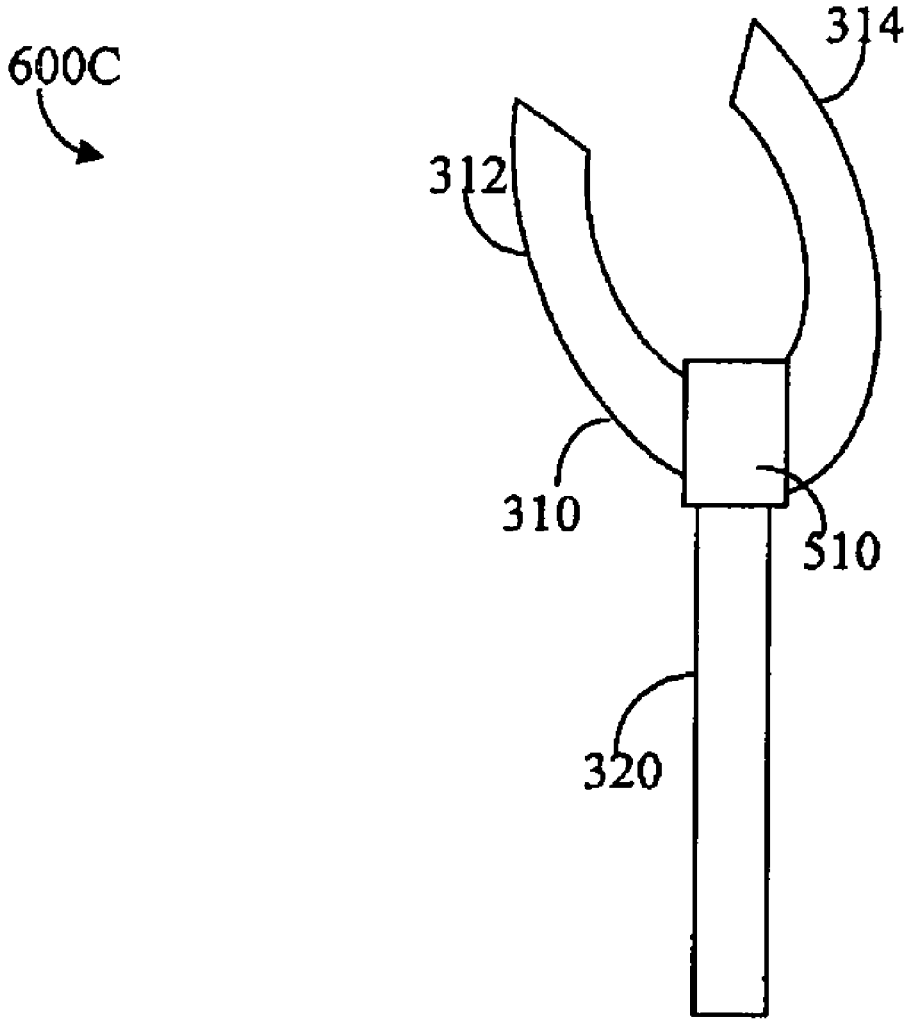

FIGS. 6A through 6C show various adjustment positions of the disclosed headrest that are achieved by independent adjustment of the arms to establish a gap there between that allows a person's hair to extend therethrough while maintaining support for said person's head. In FIG. 6A, an adjustment of the arms 312 and 314 is shown, where the arms are moved further from each other, allowing, for example, for the accommodation of a larger head or hair style. In FIG. 6B, an adjustment of arms the 312 and 314 is shown, where the arms are moved closer to each other, thereby accommodating more standard sized head. In FIG. 6C, an adjustment of the headrest is shown such that the opening of the U-shape structure 310 is somewhat to the left. The entire structure 310 may be articulated backwards and forwards, as well to allow further adjustments.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

The invention claimed is:

1. A headrest, comprising:

a single-piece, continuous and uniform U-shaped structure having two spaced apart, free arms that extend from a central portion thereof, wherein said U-shaped structure provides cushioned contact points for a person's head and neck, the U-shaped structure being cushioned in its entirety;

a bracket enabled to receive said single-piece, continuous and uniform U-shaped structure to enable motion of said U-shaped structure while retaining said U-shaped structure within said bracket; and a handle, coupled to said bracket and disposed substantially at said central portion of said U-shaped structure, substantially between said free arms, and protruding from said U-shaped structure for associating said headrest with a medical or dental chair;

wherein each arm of said single-piece, continuous and uniform U-shaped structure comprises a free-edge that is independently adjustable to either move towards a free-edge of the other arm or away from the free-edge of the other arm without causing a separation at the central portion between said each arm of said single-piece, continuous and uniform U-shaped structure; and wherein said U-shaped structure is adjustable relative to said handle with regard to any of pitch and yaw.

2. The headrest of claim 1, further comprising:

means for adjusting said U-shaped structure through any of manual, pneumatic, and electrical expedients.

3. The headrest of claim 1, wherein each one of said arms is either solid or articulated.

4. The headrest of claim 3, wherein a gap between said arms is adjustable to protect a person's hairstyling and/or reduce tilting of a person's head due to said person's hair styling by providing an adjustable gap between said arms that allows said person's hair to extend therethrough while said arms maintain support for said person's head.

5. The headrest of claim 1, further comprising:

a headrest cover.

6. The headrest of claim 5, wherein said cover is either disposable or made from a material that is readily disinfected.

7. A The headrest of claim 1, further comprising:

a chair for supporting a person in a seated or reclining position;

wherein said handle associates said headrest with said chair.

8. The apparatus of claim 7, further comprising:

means for adjusting said headrest any of closer to or further from said chair.

9. The apparatus of claim 7, said chair comprising any of: a medical table, a medical chair, and a dental chair.

* * * * *